US005575345A

United States Patent [19]

Shibasaki et al.

[11] Patent Number: 5,575,345

[45] Date of Patent: Nov. 19, 1996

[54] MULTI SHAFT DRILLING UNIT

[75] Inventors: Mitsuhiro Shibasaki, Tokyo; Hiroshi Kotacki, Sagamihara, both of Japan

[73] Assignee: Chemical Grouting Company. Ltd., Tokyo, Japan

[21] Appl. No.: 335,694

[22] Filed: Nov. 15, 1994

[51] Int. Cl.[6] ..... E21B 3/02; E02D 17/13

[52] U.S. Cl. ..... 175/108; 405/267

[58] Field of Search ..... 175/91, 108; 405/266, 405/267, 269; 299/57

[56] References Cited

U.S. PATENT DOCUMENTS

| | | | |
|---|---|---|---|
| 3,305,271 | 2/1967 | Galis et al. | 175/91 X |
| 3,663,062 | 5/1972 | Young et al. | 175/108 X |
| 5,050,320 | 9/1991 | Shibazaki et al. | 405/267 X |

FOREIGN PATENT DOCUMENTS 2-115406 4/1990 Japan .

*Primary Examiner*—David J. Bagnell

*Attorney, Agent, or Firm*—Armstrong, Westerman, Hattori, McLeland & Naughton

[57] ABSTRACT

A multi-shaft drilling unit having three auger shafts for developing a continuous under ground wall and comprises a housing for retaining pitch between the auger shafts, the housing comprising, primary transfer gears rotating around a central auger shaft, secondary transfer gears engaging with the primary transfer gears, a tertiary transfer gear connected to the primary transfer gear, a quaternary transfer gear connected to the tertiary gear and fixed to a rotary shaft orthogonally crossing a straight line connecting auger shaft centers, and cone-shaped cutters expanding the diameter outward and fixed on both ends of the rotary shaft. The cutters cut off a triangular convex and form a continuous wall unit of which both ends form a semicircle and both sides form a straight line and can be formed in subsoil. Because the cutters are coned-shaped, such a truncated cone-shaped, most of the triangular convex are drilled and the remaining parts of the triangular convex are naturally collapsed by tare weight, vibration and the other events even if the pitch between auger shaft is lengthened.

1 Claim, 15 Drawing Sheets

MULTI SHAFT DRILLING UNIT

FIELD OF THE INVENTION

The present invention relates to a multi-shaft drilling unit for producing a continuous wall under the ground and move particularly to such a unit having three rotating shafts.

DESCRIPTION OF THE PRIOR ART

A soil mixing method for producing a continuous underground wall has been widely used for some time. In such method, subsoil is drilled in a wall-shape and liquid mixed cement, and the like, has been discharged from an end point of an auger shaft to mix, in-situ, such subsoil and develop a continuous wall and forms a retaining wall and shoring up the underground soil for construction.

A multi-shaft auger machine for developing such a continuous wall is described with reference to FIGS. 5, 6, 12 and 19.

As shown in FIG. 12, a drive unit (3) is equipped to move vertically on a guide post (2) mounted on a crawler truck (1); a multi-shaft unit (4) is connected to the lower part of drive unit (3); and a plurality of auger shafts (three shafts as shown in FIG. 19) (5A, 5B and 5C) (hereinafter referred to collectively as just "5") are installed on multi-shaft unit (4).

A drilling cutter (6) is equipped at the lower end of each auger shaft (5); a screw type movable wing (7), a diameter of which wing is the same as the drilling cutter (6), and a bar-shaped auger wing (8) are alternately equipped at the upper part of each of drilling cutters (6); and each end of said auger wing, next to the other one, is reciprocally working to form a continuous wall unit by mixing the in-situ soil with mixed liquid. If necessary, to enhance water retaining character and cut-off power H-type steel and sheet pile are molded to the continuous wall.

In the aforementioned conventional multi-shaft auger machine in the prior art, some triangular irregularities, which are generated by the overlapping outer rotation of drilling cutters, appears longitudinally on both sides of the continuous wall unit and result from the auger shafts. This is not desirable for wall strength.

Therefore, in Japanese Patent Application Publication No. 2-115406, the applicant proposes a new technology to drill a continuous straight wall unit without irregularities.

According to such Japanese Patent Application Publication No. 2-115406, chain drive drilling cutters are provided angularly close to the lower ends of the auger shafts, and are quite effective. According to such prior art disclosed in Japanese Patent Application Publication No. 2-115406, however, there is a problem with respect to reliability because the machine is chain driven and the chains are apt to loosen or be damaged.

SUMMARY

An object of the present invention is to provide a highly reliable multi-shaft drilling unit for forming a continuous wall in a straight line-shape without the aforementioned prior art problems.

The housing in the multi-shaft drilling unit having three auger shafts and used to develop a continuous wall underground in the present invention desirably comprising: a primary transfer means rotating around the central auger shaft; a pair of secondary transfer means engaging with the primary transfer means; a tertiary transfer means integral with the primary transfer means; a quaternary transfer means engaging with the tertiary transfer means and fixed to a rotary shaft orthogonally crossing a line connecting the auger shaft centers; and cone-shaped cutters that expand to the side direction and are fixed to both ends of the rotary shaft.

According to an embodiment in the present invention, gears are used as the primary and secondary transfer means, and bevel gears are used as the tertiary and quaternary transfer means. In this case the primary transfer means is the primary gear; the secondary transfer means is the secondary gear; the tertiary transfer means is the primary bevel gear; and the quaternary transfer means is the secondary bevel gear.

As used herein "cone-shaped" means the shape of cutters includes a circular cone and a truncated cone.

According to one embodiment in the present invention, a guide shaft is desirably provided on one side of the line of the drilling unit equipped with a plurality of drilling shafts with centers of such shafts arranged on a line. In addition, it is also desirable to provide a guide shaft on both sides of the drilling unit equipped with a plurality of drilling shafts of which the shaft centers are also arranged on a line. Furthermore, the guide shaft is desirably equipped with a jet nozzle. Such guide shaft is desirably equipped with a tubular guide bit on which concavity is formed overlapping to a bit of drilling shaft; and the guide shaft is desirably equipped with a pair of jet nozzles in a direction toward a tangent line outside the guide.

According to such multi-shaft drilling unit, a triangular convex, which has conventionally been formed, is completely cut off by using cutters, and a continuous wall unit, both ends of which form a semicircle and both sides of which form a straight line, is formed.

According to the present invention, because the cutter is cone-shaped, such as, truncated cone-shaped and almost triangular convex (it has not been drilled previously) can be drilled and the remaining convex will naturally collapse by tare weight, vibration or other events, even if the pitch between auger shafts became longer. In other words, the pitch between auger shafts can be lengthened in the present invention. This reduces the time and labor to form a continuous wall unit.

In addition, when a guide shaft is provided on one side of a line of the drilling unit equipping a plurality of drilling shafts centers which shafts are arranged on a line, a guide hole is drilled firstly and such guide hole guides a guide shaft to drill a hole by the drilling shaft. As a result, a plurality of continuous holes can be drilled in good linearity because such guide shaft receives a reaction force. Additionally, because a hole at the end of the primary drilling hole, at which the drilling is completed, is applied as a guide hole, the continuity to the secondary drilling hole can be retained. Besides, if the unit is constructed such that a jet stream is injected from a jet nozzle, a cross section of subsoil will be drilled wedge-shaped and a drilling wing (in some cases, cone-shaped cutters, too), as well as the drilling, will be desirably washed by cone-shaped cutters.

BRIEF DESCRIPTION OF THE DRAWINGS

The following explains the preferred embodiment of the present invention making reference to the attached drawings, in which.

EMBODIMENT

Figure 1:
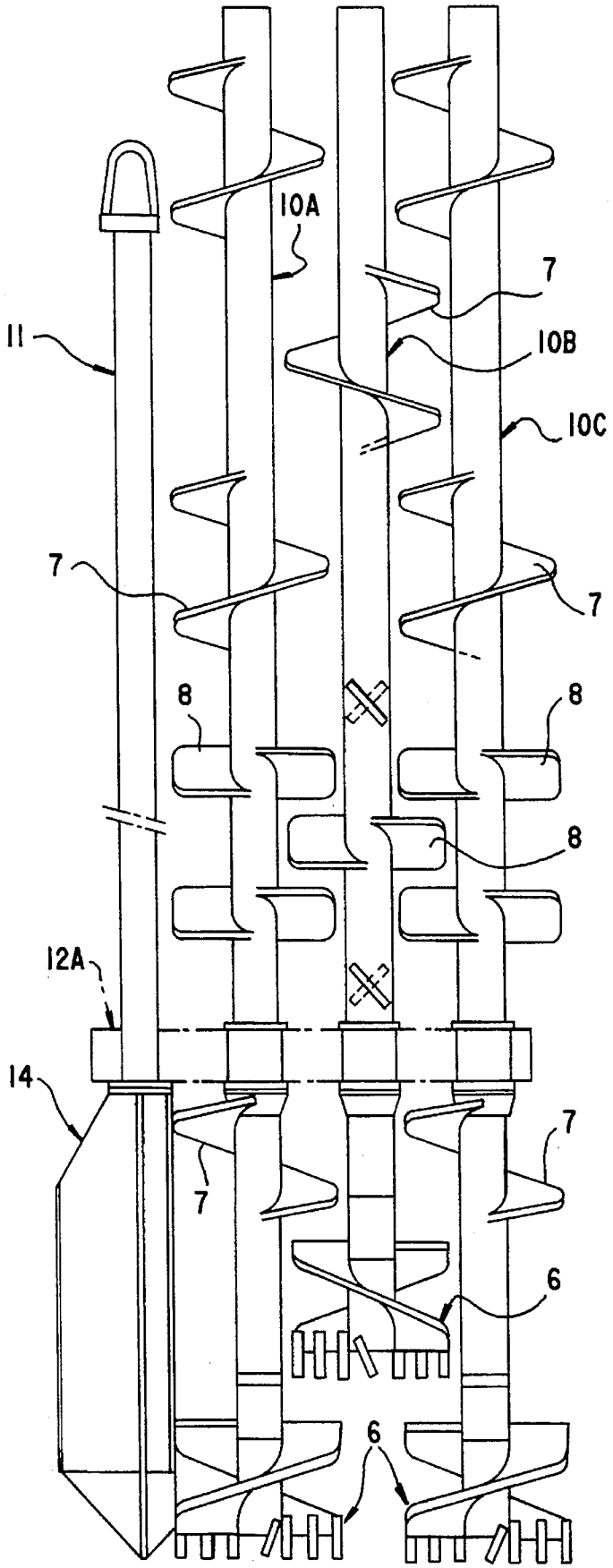
FIG. 1 is a schematic front view showing a pivotal part of an embodiment in the present invention.
Figure 2:
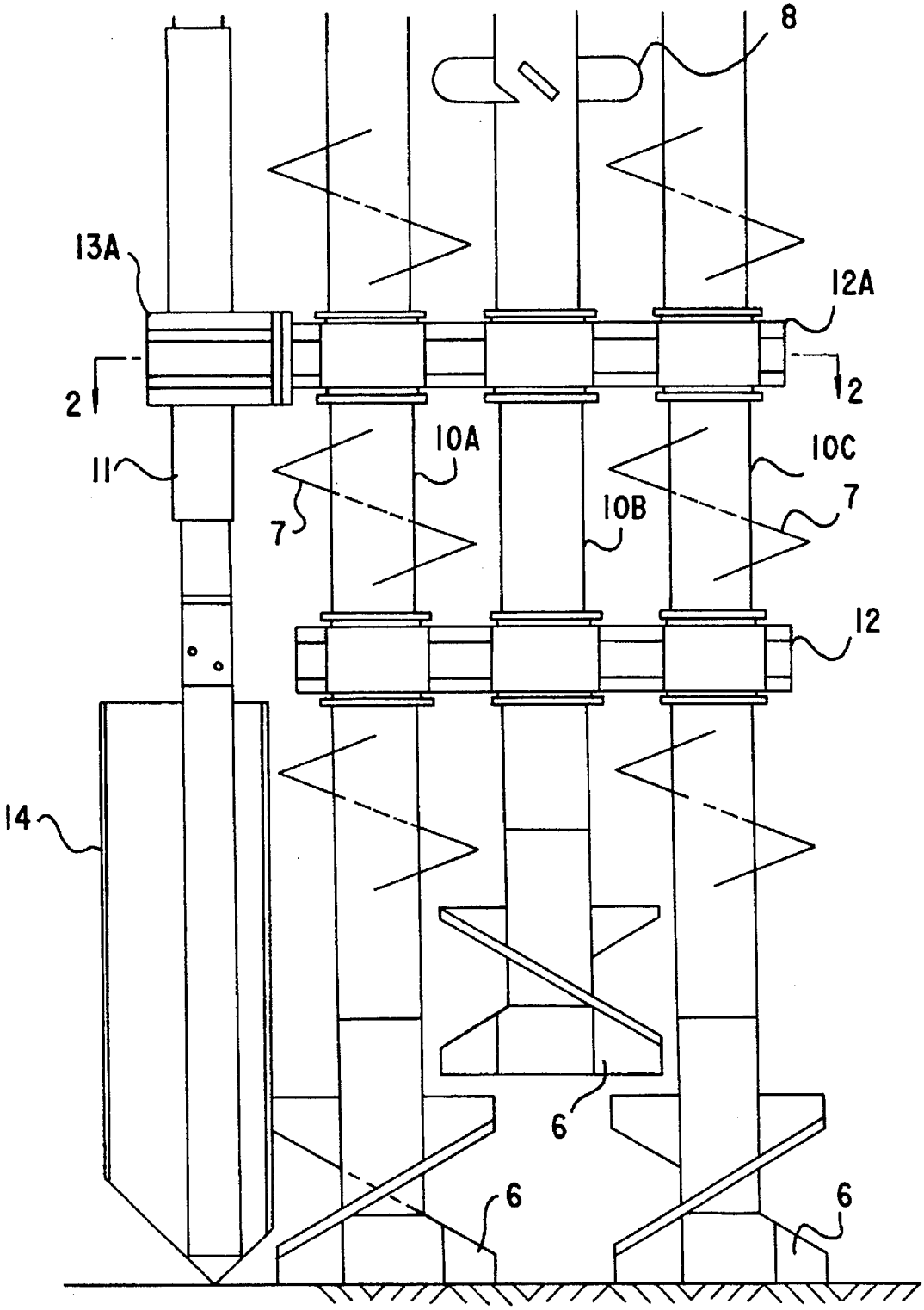
FIG. 2 is a side view of FIG. 1.
Figure 12:
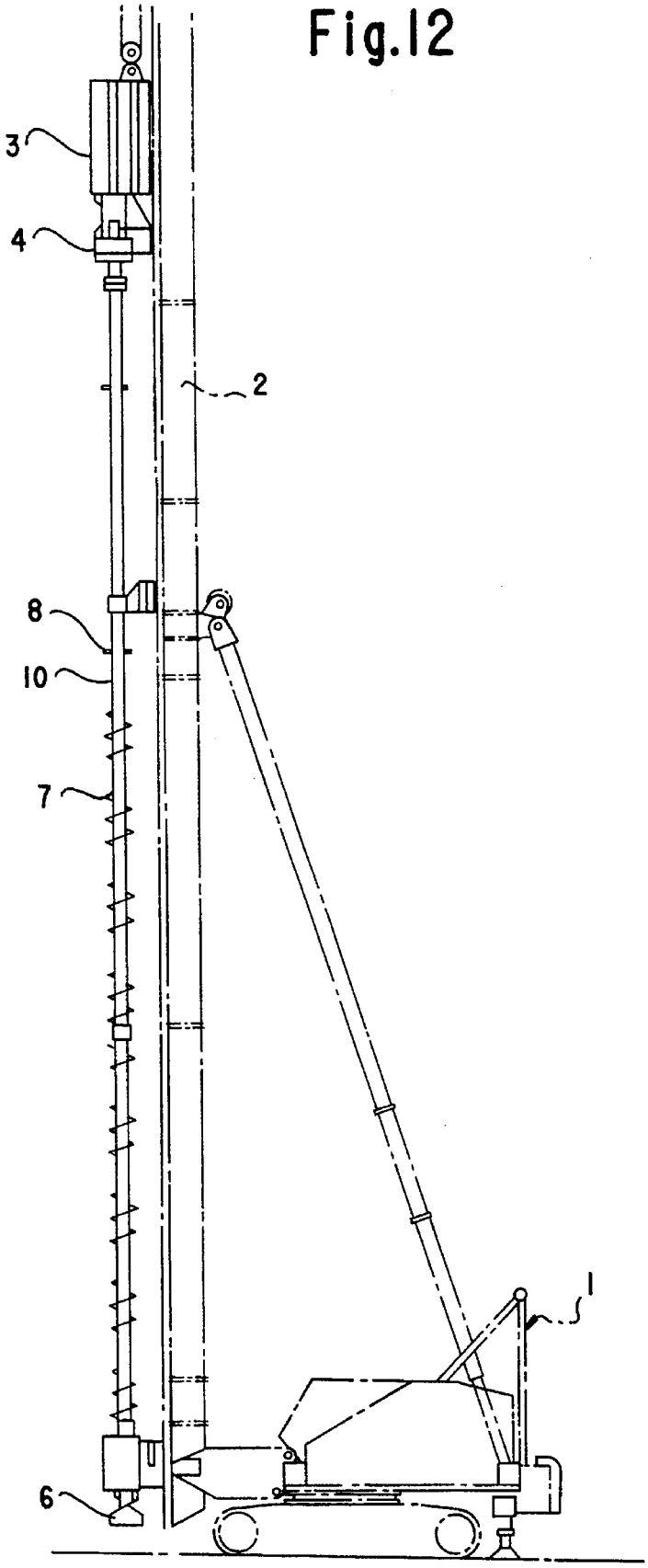
FIG. 12 is a side view showing the apparatus in a state ready for drilling.
Figure 13:
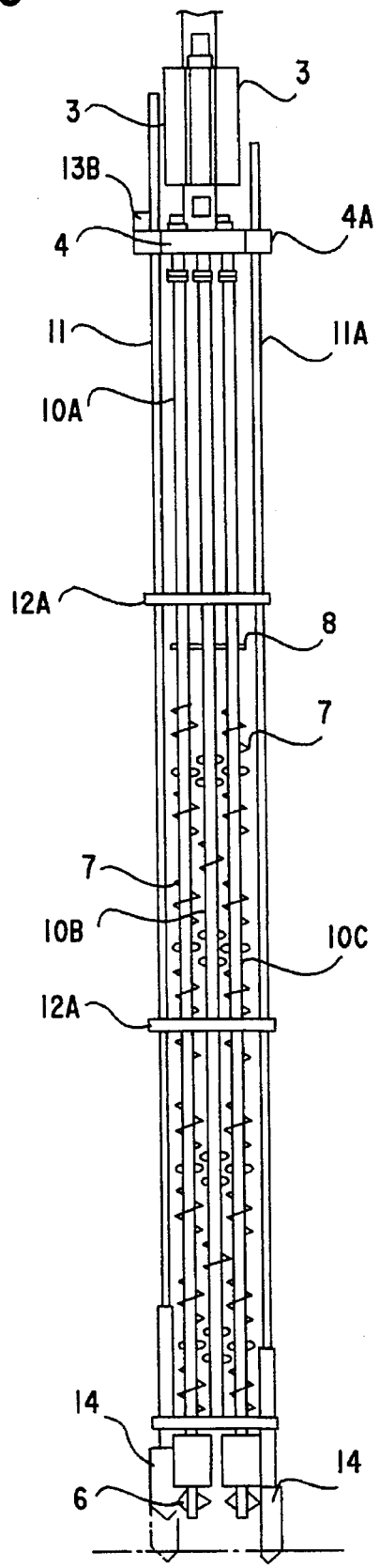
FIG. 13 is a side view of the drilling apparatus of FIG. 12.

In the embodiment of FIG. 1 and FIG. 2, a pitch between the auger shafts (10A, 10B and 10C) remains by the housing (11) of the cutter drive unit 4, FIGS. 12 and 13, provided with bearings; two pairs of cutters 14, described as follows, are equipped on unit 4 parallel to a straight line connecting shaft centers of the drilling shafts.

Figure 3:
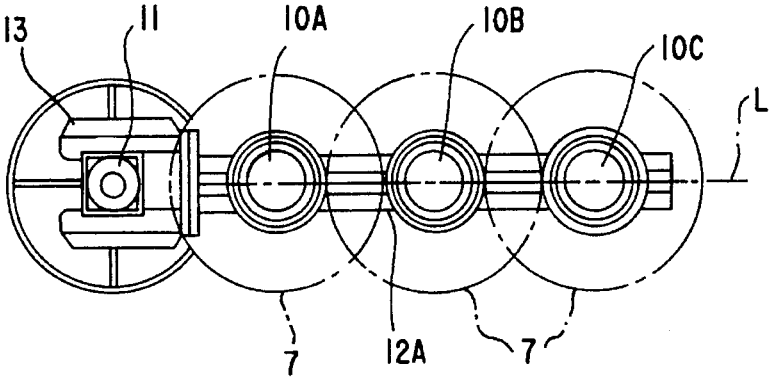
FIG. 3 is a horizontal section view of the embodiment of FIGS. 1 and 2 at 2—2, FIGS. 2, and showing details.
Figure 4:
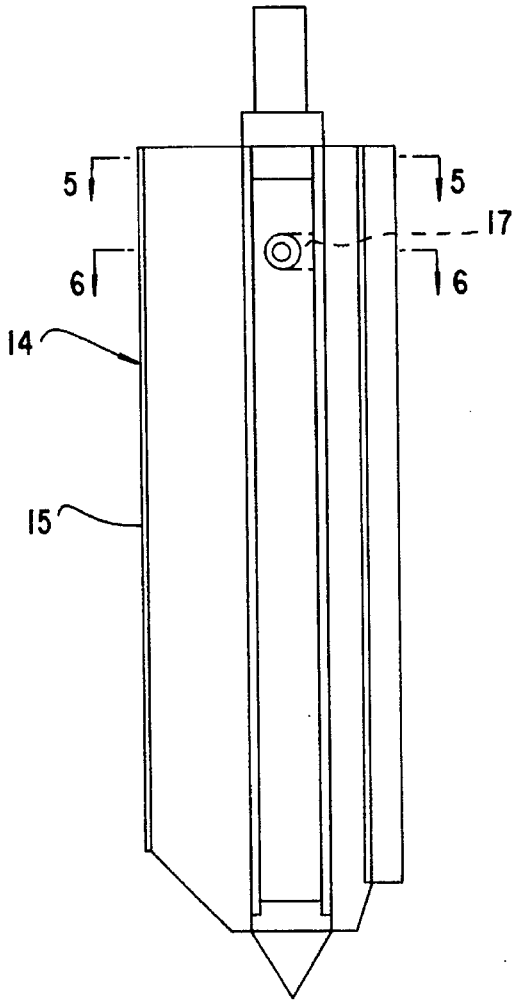
FIG. 4 is a side view of FIG. 3.
Figure 5:
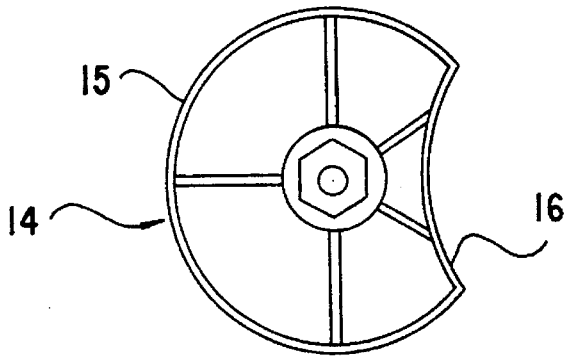
Fig.5 PRIOR ART
FIG. 5 is an end view, at 5—5, FIG. 4, showing a conventional unit of the prior art.

In FIG. 3 and FIG. 4, the housing (11) of cutter drive unit is formed in H-shaped by the primary part 12A including a straight line (L) and the two secondary parts (13) orthogonally crossing a straight line (L) at an intermediate point of each shaft.

The primary gear (the primary transfer means) is connected to the auger shaft (10B) in serration; the primary gear is engaged with a pair of secondary gears (the secondary transfer means which are arranged on the straight line (L) in the primary part 12A; the secondary gears are connected by a key to a shaft which is vertically placed in the primary bevel gear (the tertiary transfer means) projecting into the secondary part which is fixed on the upper part of the shaft.

On the other hand, a rotary shaft is placed in the secondary part through three pairs of bearings; the secondary bevel gear (the quaternary transfer means) engaging with the primary bevel gear is connected by key on the side of two pairs of bearings of the rotary shaft; a cutter is fixed on both sides of the drive shaft; and the outer cutter is formed in cone-shaped (in truncated cone-shaped in the illustrated example) expanding toward the sides to cut an outer triangular convex (A) generated on both sides of a straight line (L) by the outer rotation loci (D) of drilling cutters which overlap alternately.

Figure 14:
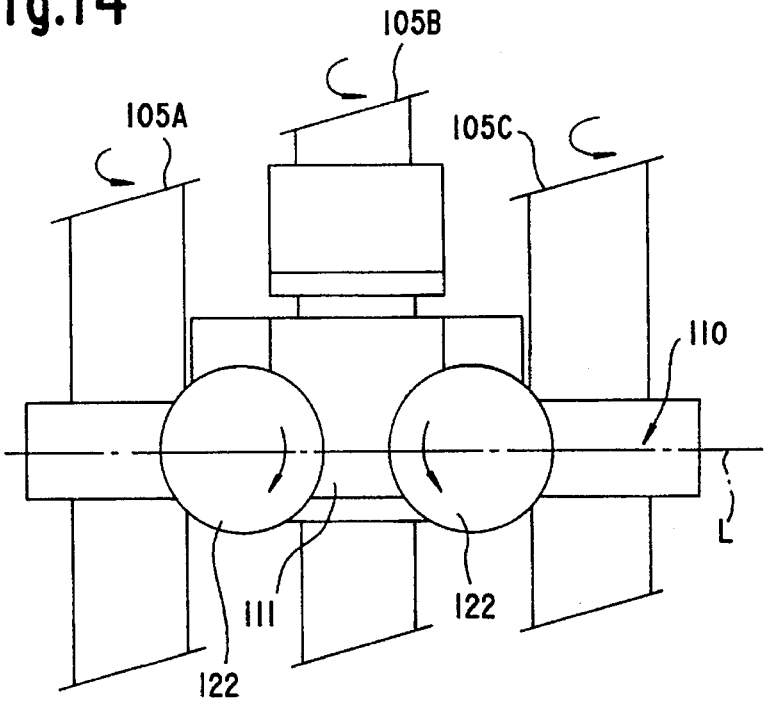
FIG. 14 is an enlarged front view of a portion of the apparatus of FIG. 12 showing a state of drilling.
Figure 16:
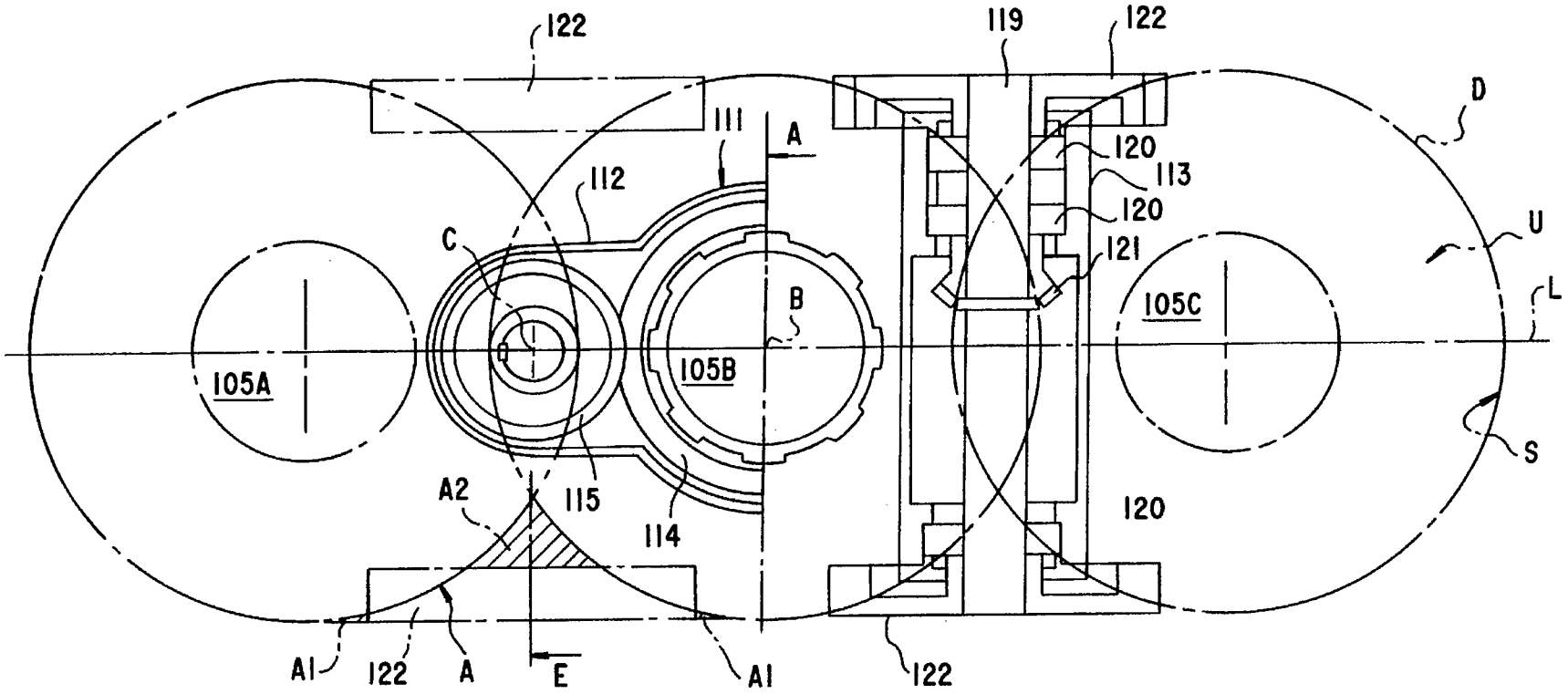
FIG. 16 is a top view showing another state of guide bit position.
Figure 17:
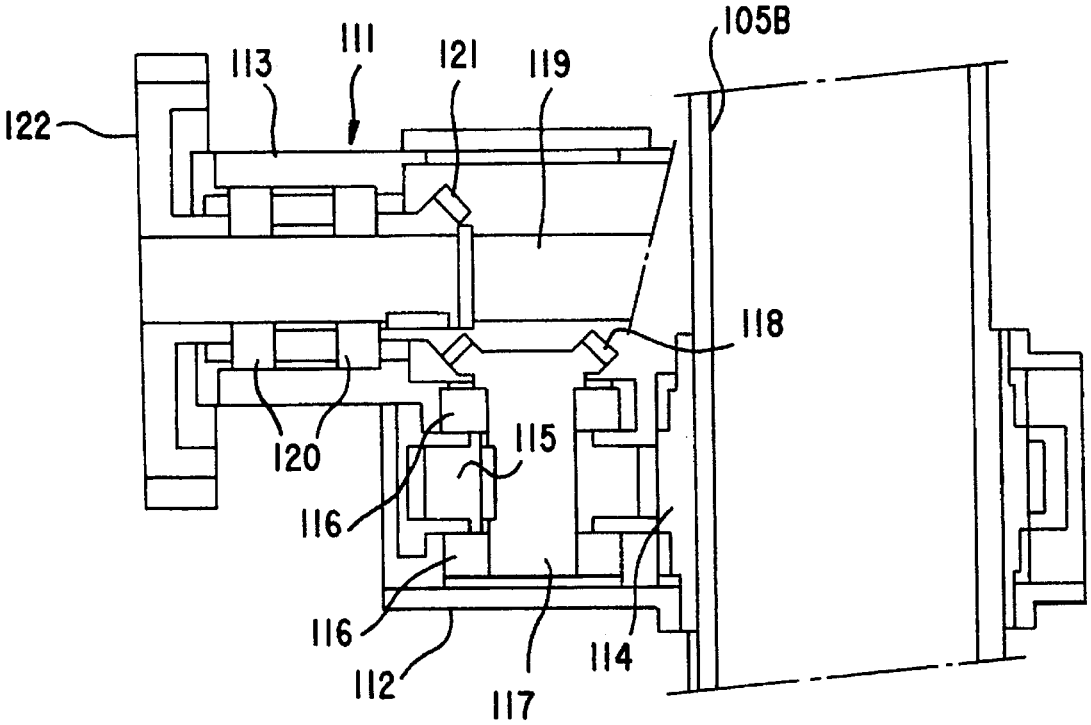
FIG. 17 is a showing such another view explaining the other state of drilling in FIG. 16.

When the auger shafts 105A, 105B and 105C, FIG. 14, rotate in the arrow head direction during drilling, a pair of cutters (FIG. 1) will rotate in opposite directions as shown by an arrow to cut the outer part (A) FIG. 16, through the primary gear 114, secondary gear 115, primary bevel gear 118, and secondary bevel gear 121, FIG. 17. As a result, a range of subsoil (S), FIG. 16, of which both ends form a semicircle and both sides form a straight line is drilled by three outer rotation loci (D) and the outer surfaces of four cutters to form a continuous wall unit (U). In this case, since such cutters rotate in opposing directions, the rotary reaction force is relieved in good balance. A part is not cut in FIG. 3, but, the part is very small and thus negligible.

In addition, auger shafts (e.g. auger shaft, 5A on left side), FIG. 16, on both sides can be moved on a straight line (L) by the moving capacity (E) within the range that can be neglected for the uncut part (A2).

Because the cutter is constructed in truncated cone-shaped, almost all of part A can be drilled and the remaining convex at which the cutter did not reach will naturally collapse by tare weight, vibration or other events even if the pitch between auger shafts became longer. Therefore, the time, labor and the other costs to form a continuous wall unit can be reduced by lengthening the pitch between auger shafts 10A, 10B and 10C.

FIG. 7 to FIG. 19 show a remarkably preferred embodiment of a continuous multi-shaft drilling unit in combination with the present invention.

Figure 7:
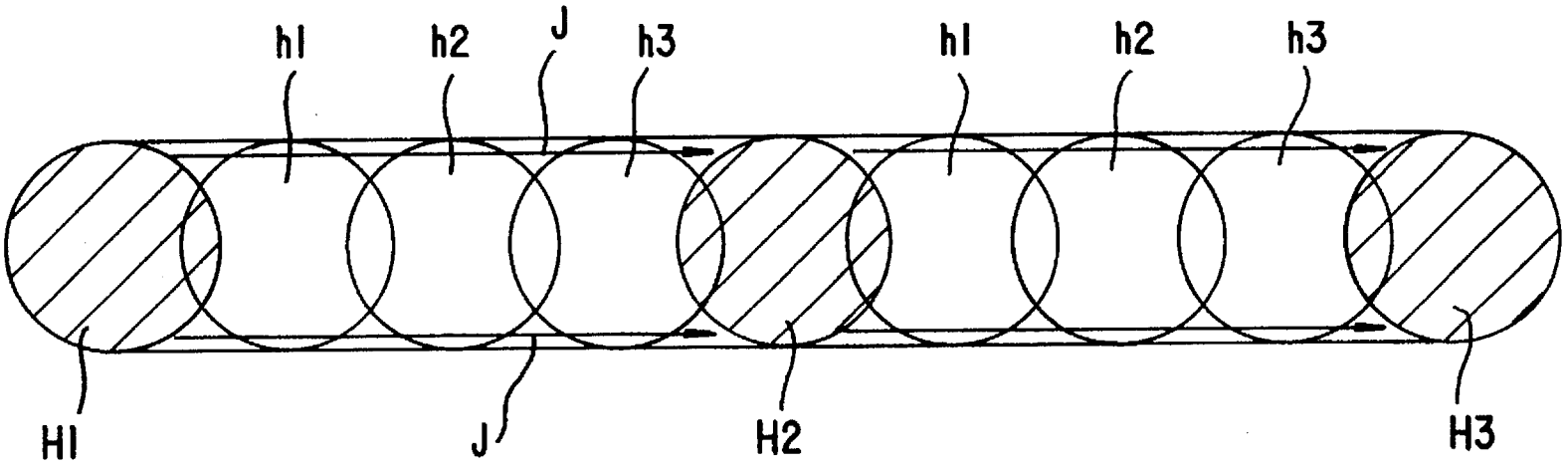
FIG. 7 is a top view, partly in section, showing a preferred embodiment of a continuous multi-shaft unit under ground walled excavation formed with apparatus of the present invention.
Figure 8:
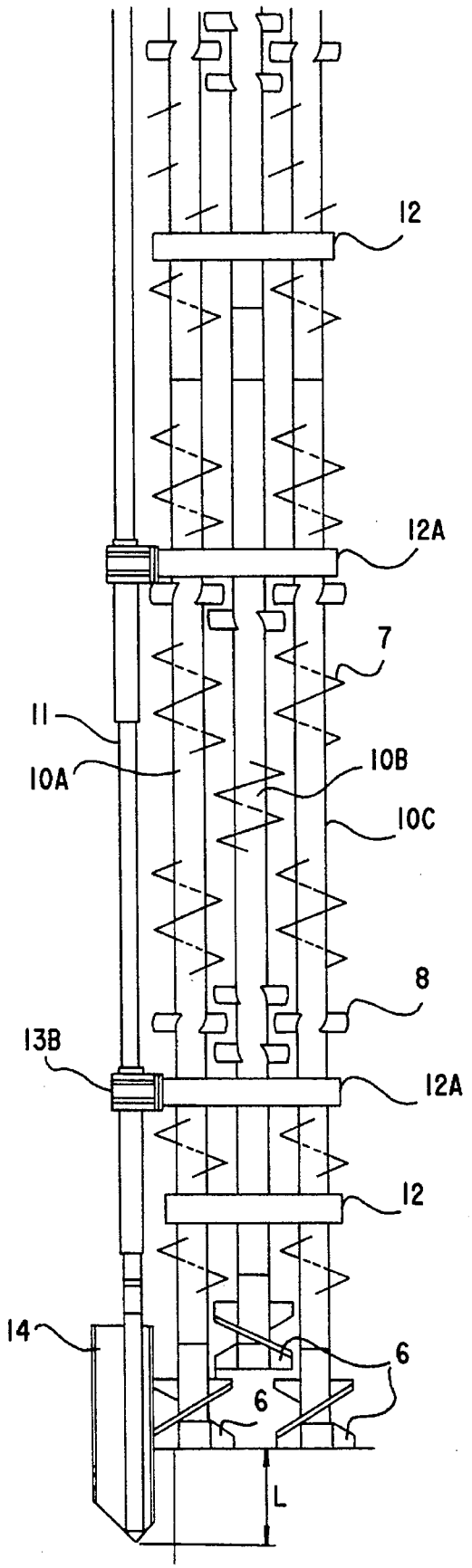
FIG. 8 shows the apparatus for producing the continuous drilling shaft of FIG. 7.
Figure 9:
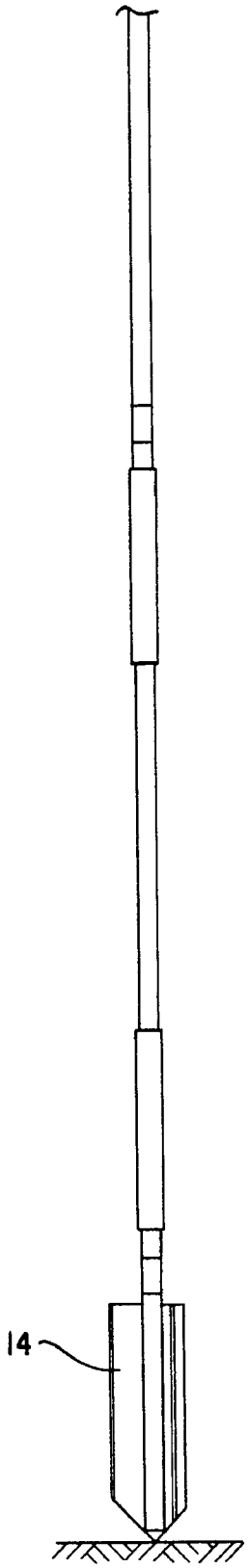
FIG. 9 is a side view of the apparatus shown in FIG. 8.

In FIG. 7 to FIG. 9, the shaft centers of a plurality (three in the example of FIG. 7 to FIG. 9) of movable drilling shafts (10A, 10B and 10C—hereinafter referred to as just "10" collectively) and a immovable guide shaft (11) are arranged on a straight line (L) at the same pitch. Those drilling shafts (10A, 10B and 10C) are mutually connected by interference prevention brackets (12) serving as a plurality of bearings; and clamp brackets (13A) that lock a guide shaft (11) selectively are connected to several brackets (12A) of such brackets (12).

Figure 10:
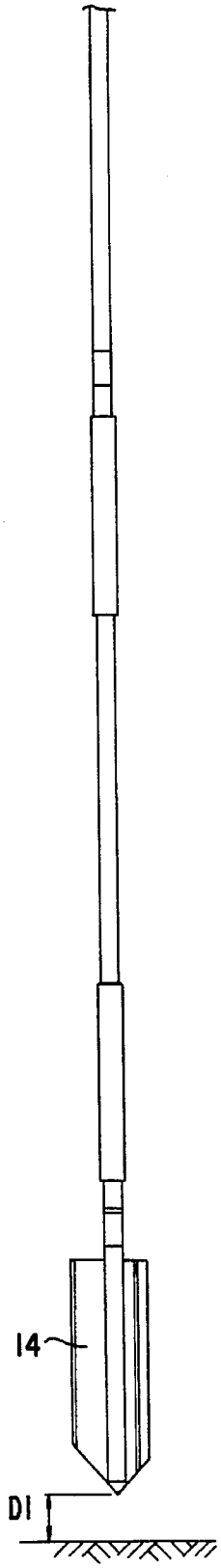
FIG. 10 is a front view showing a guide bit.
Figure 11:
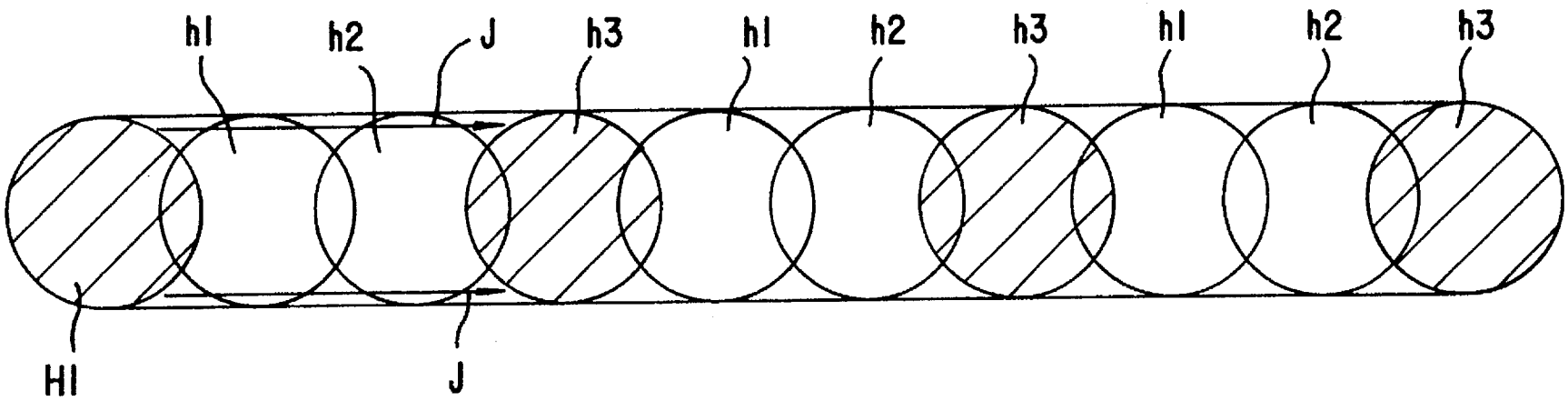
FIG. 11 is a top view partly in section similar to FIG. 7.

Referring to FIG. 10 to FIG. 12 as well, a guide bit (14) is provided at the lower end of the guide shaft (11).

Figure 6:
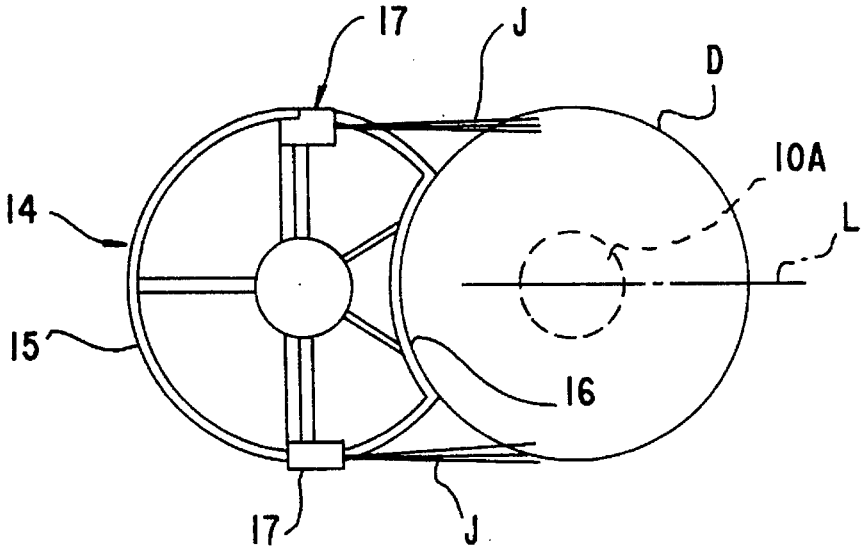
FIG. 6 is an end view similar to FIG. 5, but at 6—6, FIG. 4, and showing an auger shaft.

The body of the guide bit is tubular; the part overlapped with a drilling cutter of a drilling shaft and with an outer rotation locus of a movable wing [both of them and an outer diameter <R> of an auger wing are equally formed] is formed on a circular concavity; and a pair of jet nozzles (17), FIG. 6, that inject a jet stream (J) toward a tangent line are equipped in circumference of the body (15) parallel to a straight line (L).

Jet stream (J) injected from said jet nozzles (17) is injected toward the direction that can wash the cutters (22) (FIG. 1 to FIG. 4) or is arranged at a position where it does not interfere with the cutters (22).

The following explains the state of drilling by a continuous multi-shaft drilling unit shown in FIG. 7 to FIG. 12. As shown in FIG. 11, guide holes (H1, H2, etc.) are drilled in advance; and as shown in FIG. 13, a guide bit (14) is inserted to the guide hole (H1) at first and holes (h1, h2 and h3) are drilled by drilling shafts (10A, 10B and 10C) to drill the subsoil in wedge-shaped by a jet stream (J); doing the same operation to the guide hole (H2), that is to say, holes (h1, h2 and h3) are drilled to drill the subsoil continuously in wedge-shaped by the jet stream (J); in this case, because guide holes (HI, H2, etc.) receive drilling reaction force of the drilling shaft (10) through the guide bit (14), the linearity of the wedge-shaped section is remarkably excellent.

In addition, as shown in FIG. 13, the holes are drilled such that the guide bit (14) lowers by only the length L (e.g. 500 mm–700 mm), FIG. 8, than the drilling cutter (6) of the drilling shaft (10). In this case, guiding by the guide bit (14) is good, however, some operation that the clamp of the guide shaft (11) can be released by a clamp block (13B), FIG. 8, and a guide bit (14) can be free before the length L showing a scheduled drilling depth as required.

Figure 15:
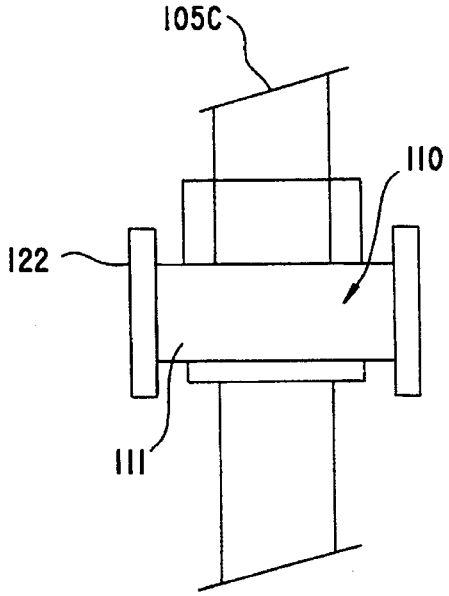
FIG. 15 is a side view of a portion of the apparatus of FIG. 14 and showing a state of guide bit position.

As shown in FIG. 15, when drilling is done at the same level of a guide bit (14) and a drilling cutter (6) on the subsoil, or as shown in FIG. 16, when drilling is done in a state where a guide bit (14) is pulled up by the length D1 (e.g. 300 mm to 550 mm) than a drilling cutter (6), the release of a clamp of the guide bit (14) will not be required as above mentioned, however, because the guiding ability slightly decreases, it is desirable for the unstable ground.

FIG. 7 shows another embodiment of drilling. When the first drilling on a guide hole (H1) is completed, the second drilling will be executed as such a hole (h3), FIG. 11, is a guide hole. In this case, the linearity is further desirable and a need of a jet stream (J) can be decreased in comparison with the aforementioned embodiment.

Figure 18:
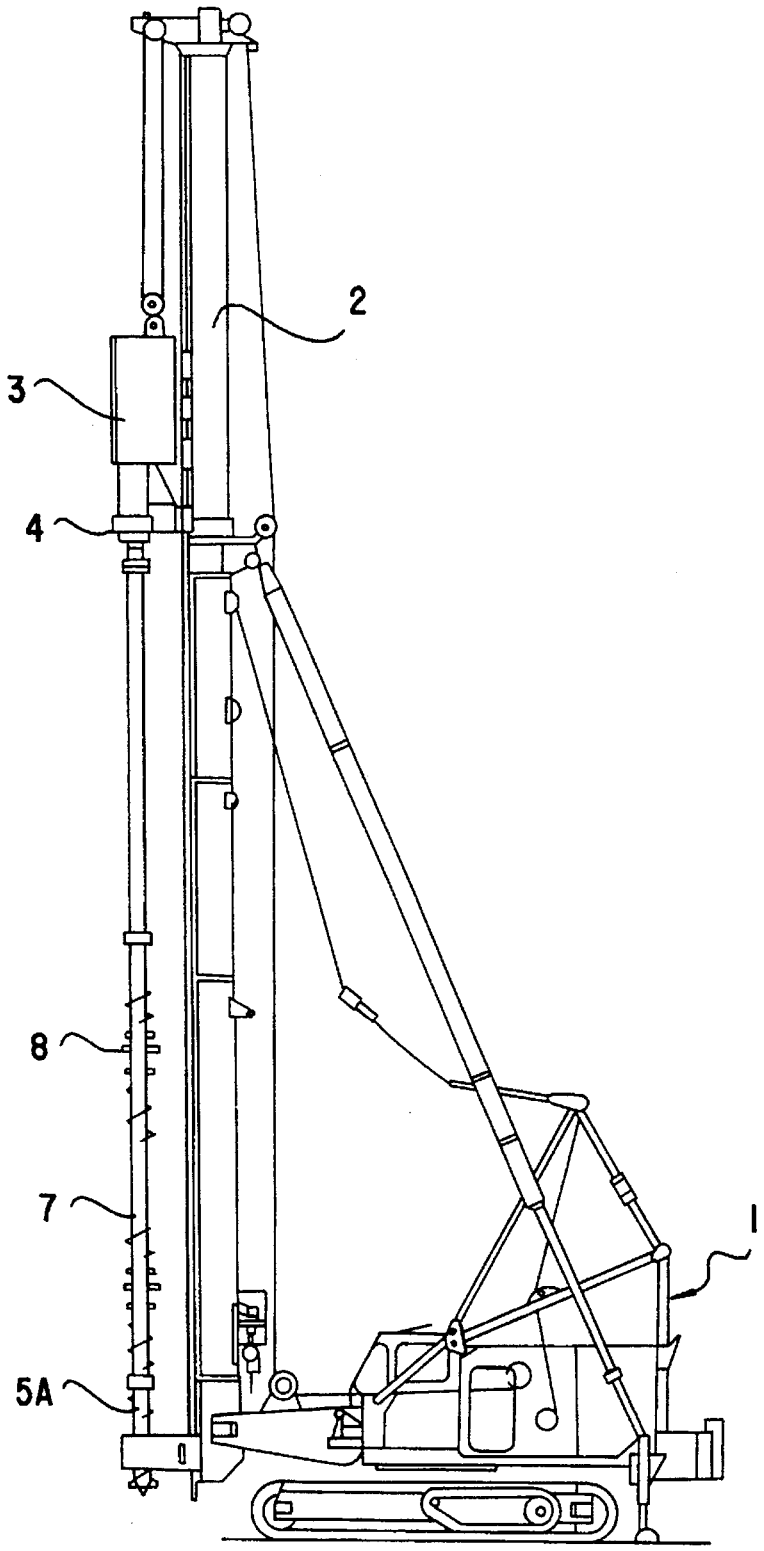
FIG. 18 is a side view showing another embodiment of a continuous multi-shaft drilling unit of the present invention.
Figure 19:
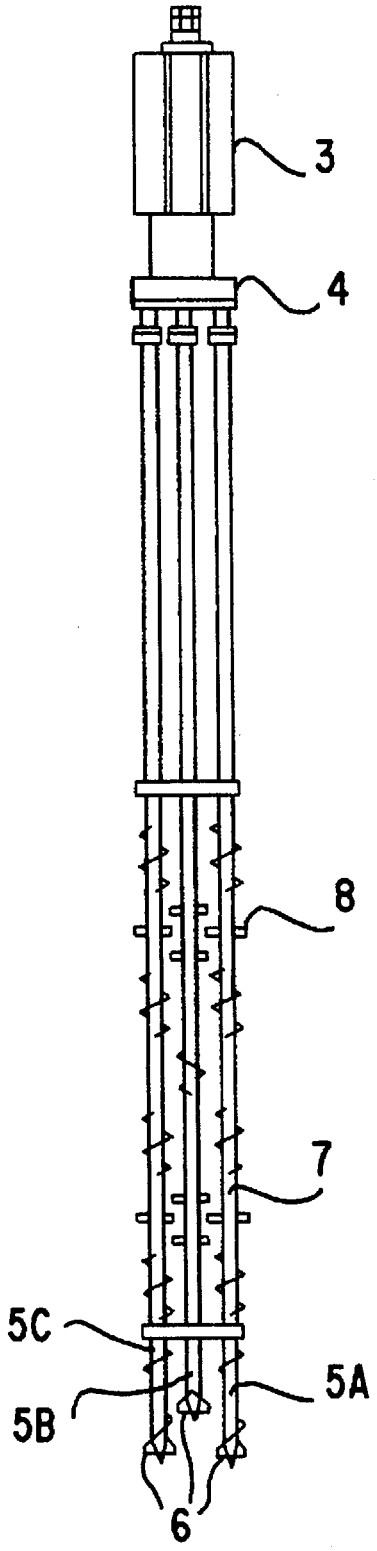
FIG. 19 is a front view showing a continuous multi shaft drilling unit of FIG. 18.

FIG. 18 and FIG. 19 show still another embodiment in the present invention exemplifying that guide shafts are separately equipped on both sides of each drilling shaft (5A, 5B and 5C). According to this embodiment, as shown in FIG. 11, guide holes (H1, H2) are used and the jet stream (J) is oppositely injected from such holes to do drilling so that the linearity can further be improved.

The embodiments illustrated are examples carrying out the invention and, therefore, the new technology employed in the invention is not limited to such embodiments. For example, the primary gear, secondary gear, primary bevel gear and secondary bevel gear, correspond to the transfer means (primary to quaternary) in the illustrated embodiment, may be replaced with other rolling transfer mechanism.

What is claimed is:

1. A multi-shaft drilling unit equipped with three auger shafts for developing a continuous wall under ground comprised of: a housing for retaining pitch between said auger shafts; said housing comprising;

a primary transfer means rotating around a central auger shaft;

a pair of secondary transfer means engaging with said primary transfer means;

a tertiary transfer means integral to said primary transfer means;

a quaternary transfer means engaging with said primary transfer means and fixed to a rotary shaft orthogonally crossing a straight line connecting said auger shaft centers; and cone-shaped cutters expanding the diameter outward fixed on opposite ends of said rotary shaft.

* * * * *